US009328480B2

(12) United States Patent
Akiyama et al.

(10) Patent No.: US 9,328,480 B2
(45) Date of Patent: May 3, 2016

(54) HYDRAULIC EXCAVATOR

(75) Inventors: Teruo Akiyama, Kokubunji (JP); Noboru Iida, Chigasaki (JP); Kenji Oshima, Tokyo (JP); Kenji Sasano, Hiratsuka (JP)

(73) Assignee: KOMATSU LTD., Tokyo (JP)

( * ) Notice: Subject to any disclaimer, the term of this patent is extended or adjusted under 35 U.S.C. 154(b) by 369 days.

(21) Appl. No.: 14/127,652

(22) PCT Filed: Aug. 13, 2012

(86) PCT No.: PCT/JP2012/070596

§ 371 (c)(1),
(2), (4) Date: Dec. 19, 2013

(87) PCT Pub. No.: WO2013/027618

PCT Pub. Date: Feb. 28, 2013

(65) Prior Publication Data

US 2014/0123847 A1 May 8, 2014

(30) Foreign Application Priority Data

Aug. 24, 2011 (JP) ..... 2011-182940

(51) Int. Cl.
*F15B 11/00* (2006.01)
*E02F 9/20* (2006.01)
(Continued)

(52) U.S. Cl.
CPC ..... *E02F 9/2025* (2013.01); *E02F 9/123* (2013.01); *E02F 9/2037* (2013.01);
(Continued)

(58) Field of Classification Search
CPC ..... E02F 9/2025; E02F 9/2037; F15B 11/17; F15B 2211/2656; F15B 2211/31547
USPC ..... 91/508, 532
See application file for complete search history.

(56) References Cited

U.S. PATENT DOCUMENTS 7,904,224 B2 * 3/2011 Kanayama ..... E02F 9/2025 172/132
2005/0246082 A1 11/2005 Miki et al.
2010/0043420 A1 * 2/2010 Ikeda ..... E02F 9/2239 60/420

FOREIGN PATENT DOCUMENTS

JP 57-54635 A 4/1982
JP 61-151333 A 7/1986
(Continued)

OTHER PUBLICATIONS

International Search Report for the corresponding international application No. PCT/JP2012/070596, issued on Nov. 20, 2012.

*Primary Examiner* — Nathaniel Wiehe
*Assistant Examiner* — Daniel Collins
(74) *Attorney, Agent, or Firm* — Global IP Counselors, LLP

(57) ABSTRACT

In a hydraulic excavator, a hydraulic cylinder drives a boom via a hydraulic fluid discharged from a first hydraulic pump. A first hydraulic circuit connects the first hydraulic pump and the hydraulic cylinder and forms a closed circuit therebetween. A hydraulic motor rotates a revolving upper unit with hydraulic fluid discharged from a second hydraulic pump. A second hydraulic circuit independent from the first hydraulic circuit connects the second hydraulic pump and the hydraulic motor. A motor hydraulic pressure reduction unit reduces the driving hydraulic pressure of the hydraulic motor when a predetermined condition is satisfied. The predetermined condition is a condition in which an operation of the boom operating member to raise the boom and an operation of the rotation operating member to rotate the revolving upper unit are conducted together and an operation amount of the boom operating member is equal to or greater than a predetermined threshold.

9 Claims, 6 Drawing Sheets

(51) Int. Cl.

| | |
|---|---|
| ***F15B 11/17*** | (2006.01) |
| ***E02F 9/12*** | (2006.01) |
| ***E02F 9/22*** | (2006.01) |
| ***F15B 11/02*** | (2006.01) |
| ***F15B 11/028*** | (2006.01) |

(52) U.S. Cl.

CPC ..... *E02F 9/2235* (2013.01); *E02F 9/2289* (2013.01); *E02F 9/2292* (2013.01); *E02F 9/2296* (2013.01); *F15B 11/02* (2013.01); *F15B 11/028* (2013.01); *F15B 11/17* (2013.01); *F15B 2211/20546* (2013.01); *F15B 2211/20561* (2013.01); *F15B 2211/20576* (2013.01); *F15B 2211/27* (2013.01); *F15B 2211/50518* (2013.01); *F15B 2211/5159* (2013.01); *F15B 2211/526* (2013.01); *F15B 2211/6346* (2013.01); *F15B 2211/665* (2013.01); *F15B 2211/6653* (2013.01); *F15B 2211/6654* (2013.01); *F15B 2211/7053* (2013.01); *F15B 2211/7058* (2013.01); *F15B 2211/7135* (2013.01)

(56) References Cited

FOREIGN PATENT DOCUMENTS

| | | | |
|---|---|---|---|
| JP | 2003-4005 | A | 1/2003 |
| JP | 2004-190845 | A | 7/2004 |
| JP | 2005-76781 | A | 3/2005 |
| JP | 2009-511831 | A | 3/2009 |

* cited by examiner

HYDRAULIC EXCAVATOR

CROSS-REFERENCE TO RELATED APPLICATIONS

This application is a U.S. National stage application of International Application No. PCT/JP2012/070596, filed on Aug. 13, 2012. This U.S. National stage application claims priority under 35 U.S.C. §119(a) to Japanese Patent Application No. 2011-182940, filed in Japan on Aug. 24, 2011, the entire contents of which are hereby incorporated herein by reference.

BACKGROUND

1. Field of the Invention

The present invention relates to a hydraulic excavator.

2. Background Information

A hydraulic excavator is provided with working implement including a boom. The boom is driven by a hydraulic cylinder. The hydraulic cylinder is driven by hydraulic fluid discharged from a hydraulic pump. The hydraulic excavator is provided with a revolving upper unit and an undercarriage. The revolving upper unit rotates by being driven by a hydraulic motor. The hydraulic motor is driven by hydraulic fluid discharged from the hydraulic pump. For example, the hydraulic cylinder and the hydraulic motor in a conventional hydraulic excavator disclosed in Japanese Laid-open Patent Publication No. 2003-004005 are connected in parallel to the hydraulic pump.

Boom raising and rotating operations are performed at the same time in the hydraulic excavator. For example, the hydraulic excavator rotates while raising the boom to place excavated dirt beside the vehicle when performing work to excavate a ditch. Alternatively, the hydraulic excavator rotates while raising the boom to deposit dirt in a dump truck parked beside the hydraulic excavator when performing loading work. When these boom raising and rotating operations are conducted at the same time, the relationship between a time needed for moving the revolving upper unit to a certain position and an amount of raising the boom during the time needs to be adjusted carefully. For example, when performing loading work onto a dump truck, the boom needs to be raised so that the bucket reaches a position higher than the bed of the dump truck when the revolving upper unit is rotating to the position of the dump truck.

The hydraulic cylinder and the hydraulic motor in the abovementioned conventional hydraulic excavator are connected in parallel to a hydraulic pump. As a result, a rotation motor is driven with hydraulic pressure that is the same as the hydraulic pressure for driving the boom cylinder when the boom raising and the rotating operations are conducted at the same time. Thus, the rotating time of the revolving upper unit and the boom raising amount during the rotating time can be synchronized to achieve a certain relationship.

Conversely, a hydraulic excavator has recently been proposed that is provided with a closed hydraulic pressure circuit for supplying hydraulic fluid to the hydraulic cylinder as described in Japanese National Publication of International Patent Application No. 2009-511831 Potential energy of the working implement is regenerated due to the hydraulic circuit being a closed circuit. As a result, the fuel consumption of the motor for driving the hydraulic pump can be reduced.

SUMMARY

The following problem arises when the closed hydraulic pressure circuit (referred to as "boom circuit" below) for driving the boom cylinder as described in Japanese National Publication of International Patent Application No. 2009-511831 is arranged independently of the hydraulic circuit (referred to as "rotation circuit" below) for driving the hydraulic motor as described in Japanese Laid-open Patent Publication No. 2003-004005.

When the boom circuit and the rotation circuit are independent from each other, the rotation motor is driven by a setting pressure of a rotation relief valve provided in the rotation circuit. However, the setting pressure of the rotation relief valve is larger than the boom drive pressure when the boom raising operation and the rotating operation are conducted at the same time. For example, the setting pressure of the rotation relief valve is about 30 MPa. In contrast, the boom drive pressure fluctuates in accordance with the presence or absence of a load of dirt in the bucket and the amount of dirt in the bucket, and thus is about 13 to 17 MPa. Therefore, if the boom circuit as described in Japanese National Publication of International Patent Application No. 2009-511831 is used in the hydraulic circuit of the conventional hydraulic excavator, there is a concern that the bucket may not be raised to the necessary height when the hydraulic excavator rotates to the position of the dump truck since the rotation speed is higher than the rotation speed of the conventional hydraulic excavator.

An object of the present invention is to allow synchronization of the rotation time of the revolving upper unit and the boom raising amount during the rotation time in a hydraulic excavator that uses a hydraulic circuit in which the boom circuit is independent.

A hydraulic excavator according to a first aspect of the present invention is provided with an undercarriage, a revolving upper unit, working implement, a first hydraulic pump, a hydraulic cylinder, a first hydraulic circuit, a second hydraulic pump, a hydraulic motor, a second hydraulic circuit, a boom operating member, a rotation operating member, and a motor hydraulic pressure reduction unit. The revolving upper unit is disposed on the undercarriage and is provided in a manner that allows rotation with respect to the undercarriage. The working implement includes a boom. The boom is provided in a manner that allows swinging on the revolving upper unit. The first hydraulic pump discharges hydraulic fluid. The hydraulic cylinder drives a boom with hydraulic fluid discharged from the first hydraulic pump. The first hydraulic circuit connects the first hydraulic pump and the hydraulic cylinder and forms a closed circuit between the first hydraulic pump and the hydraulic cylinder. The second hydraulic pump discharges hydraulic fluid. The hydraulic motor rotates the revolving upper unit with hydraulic fluid discharged from the second hydraulic pump. The second hydraulic circuit is provided independently of the first hydraulic circuit and connects the second hydraulic pump and the hydraulic motor. The boom operating member is a member for operating the boom. The rotation operating member is a member for operating the rotation of the revolving upper unit. The motor hydraulic pressure reduction unit reduces the driving hydraulic pressure of the hydraulic motor when a predetermined condition is satisfied. The predetermined condition is a condition that an operation of the boom operating member for raising the boom and an operation of the rotation operating member for rotating the revolving upper unit are conducted together and an operation amount of the boom operating member is equal to or greater than a predetermined threshold.

A hydraulic excavator according to a second aspect of the present invention is related to the hydraulic excavator of the first aspect, wherein the motor hydraulic pressure reduction unit reduces the driving hydraulic pressure of the hydraulic motor so that an acceleration of the rotation of the revolving upper unit is reduced when the predetermined condition is satisfied.

A hydraulic excavator according to a third aspect of the present invention is related to the hydraulic excavator of the first aspect, wherein the motor hydraulic pressure reduction unit reduces the driving hydraulic pressure of the hydraulic motor so that a steady-state velocity of the rotation of the revolving upper unit is maintained and the acceleration of the rotation of the revolving upper unit is reduced when the predetermined condition is satisfied.

A hydraulic excavator according to a fourth aspect of the present invention is related to the hydraulic excavator of the first aspect, wherein the motor hydraulic pressure reduction unit includes a hydraulic pressure adjusting mechanism and a setting pressure control unit. The hydraulic pressure adjusting mechanism is provided in the second hydraulic circuit. The setting pressure control unit controls the hydraulic pressure adjusting mechanism. The hydraulic pressure adjusting mechanism adjusts the hydraulic pressure of the second hydraulic circuit so that a driving hydraulic pressure of the hydraulic motor does not exceed a predetermined setting pressure. The setting pressure is variable. The setting pressure control unit reduces the setting pressure when the predetermined condition is satisfied.

A hydraulic excavator according to a fifth aspect of the present invention is related to the hydraulic excavator of the fourth aspect, wherein the hydraulic pressure adjusting mechanism is a relief valve that allows switching of the setting pressure between a predetermined first setting pressure and a predetermined second setting pressure. The second setting pressure is lower than the first setting pressure. The setting pressure control unit switches the setting pressure from the first setting pressure to the second setting pressure when the predetermined condition is satisfied.

A hydraulic excavator according to a sixth aspect of the present invention is related to the hydraulic excavator of the fourth aspect, wherein the hydraulic pressure adjusting mechanism includes a first relief valve and a second relief valve. The first relief valve adjusts the hydraulic pressure of the second hydraulic circuit so that the driving hydraulic pressure of the hydraulic motor does not exceed the first setting pressure. The second relief valve adjusts the hydraulic pressure of the second hydraulic circuit so that the driving hydraulic pressure of the hydraulic motor does not exceed the second setting pressure which is lower than the first setting pressure. The setting pressure control unit uses the first relief valve to adjust the hydraulic pressure of the second hydraulic circuit when the predetermined condition is not satisfied. The setting pressure control unit uses the second relief valve to adjust the hydraulic pressure of the second hydraulic circuit when the predetermined condition is satisfied.

A hydraulic excavator according to the seventh aspect of the present invention is related to the hydraulic excavator of the fifth aspect, wherein the second setting pressure is the same as the driving hydraulic pressure of the hydraulic cylinder when raising the boom.

A hydraulic excavator according to an eighth aspect of the present invention is related to the hydraulic excavator of the fourth aspect, and further includes a cylinder hydraulic pressure detecting unit. The cylinder hydraulic pressure detecting unit detects the driving hydraulic pressure of the hydraulic cylinder. The hydraulic pressure adjusting mechanism is a relief valve that allows for a continuous change of the setting pressure. The setting pressure control unit changes the setting pressure in response to the driving hydraulic pressure of the hydraulic cylinder detected by the cylinder hydraulic pressure detecting unit.

A hydraulic excavator according to a ninth aspect of the present invention is related to the hydraulic excavator of the fourth to eighth aspects, and further includes a hydraulic pressure control valve. The hydraulic pressure control valve is provided in the second hydraulic circuit and controls the driving hydraulic pressure of the hydraulic motor. The hydraulic pressure adjusting mechanism is located further downstream than the hydraulic pressure control valve in the flow of hydraulic fluid from the second hydraulic pump toward the hydraulic motor in the second hydraulic circuit.

The driving hydraulic pressure of the hydraulic motor is reduced in the hydraulic excavator according to the first aspect of the present invention when the predetermined condition is satisfied. The predetermined condition is a condition that an operation of the boom operating member for raising the boom and an operation of the rotation operating member for rotating the revolving upper unit (referred to as "combined rotation operation" below) are conducted together, and the operation amount of the boom operating member is equal to or greater than a predetermined threshold. Therefore, the driving hydraulic pressure of the hydraulic motor is able to approximate the driving hydraulic pressure of the hydraulic cylinder during the combined rotation operation. Thus, the rotating time of the revolving upper unit and the boom raising amount during the rotating time can be synchronized. Since the predetermined condition is not satisfied when the operation amount of the boom operating member is smaller than the predetermined threshold, the reduction of the driving hydraulic pressure of the hydraulic motor by the motor hydraulic pressure reduction unit is not conducted. As a result, a rotational force can be maintained when raising the boom a small amount even when the combined rotation operation is being conducted.

The acceleration of the rotation of the revolving upper unit is reduced in the hydraulic excavator according to the second aspect of the present invention when the predetermined condition is satisfied. Thus, the rotating time of the revolving upper unit and the boom raising amount during the rotating time can be synchronized.

The steady-state velocity of the rotation of the revolving upper unit is maintained and the acceleration of the rotation of the revolving upper unit is reduced in the hydraulic excavator according to the third aspect of the present invention when the predetermined condition is satisfied. Thus, the rotating time of the revolving upper unit and the boom raising amount during the rotating time can be synchronized. Further, a reduction in the steady-state velocity of the rotation can be prevented.

The driving hydraulic pressure of the hydraulic motor can be reduced by reducing the setting pressure of the hydraulic pressure adjusting mechanism in the hydraulic excavator according to the fourth aspect of the present invention.

The driving hydraulic pressure of the hydraulic motor can be reduced by switching the setting pressure of the relief valve from the first setting pressure to the second setting pressure in the hydraulic excavator according to the fifth aspect of the present invention. That is, a mechanism for reducing the driving hydraulic pressure of the hydraulic motor can be realized by using a so-called two-stage relief valve.

The hydraulic pressure in the second hydraulic circuit can be adjusted by the first relief valve when the predetermined condition is not satisfied in the hydraulic excavator according to the sixth aspect of the present invention. The hydraulic pressure in the second hydraulic circuit can be adjusted by the second relief valve when the predetermined condition is satisfied. That is, a mechanism for reducing the driving hydraulic pressure of the hydraulic motor can be realized by using two relief valves.

The second setting pressure is the same as the driving hydraulic pressure of the hydraulic cylinder when raising the boom in the hydraulic excavator according to the seventh aspect of the present invention. As a result, the driving hydraulic pressure of the hydraulic motor is able to approximate the driving hydraulic pressure of the hydraulic cylinder when the boom is being raised.

The setting pressures are changed in response to the driving hydraulic pressure of the hydraulic cylinder detected by the cylinder hydraulic pressure detecting unit in the hydraulic excavator according to the eighth aspect of the present invention. As a result, the driving hydraulic pressure of the hydraulic motor can be reduced to a value corresponding to the driving hydraulic pressure of the hydraulic cylinder.

The hydraulic pressure adjusting mechanism is located further downstream in the second hydraulic circuit than the hydraulic pressure control valve in the hydraulic excavator according to the ninth aspect of the present invention. As a result, the driving hydraulic pressure of the hydraulic motor can be changed independently of the hydraulic pressure control valve by the hydraulic pressure adjusting mechanism.

DETAILED DESCRIPTION OF EMBODIMENT(S)

Figure 1:
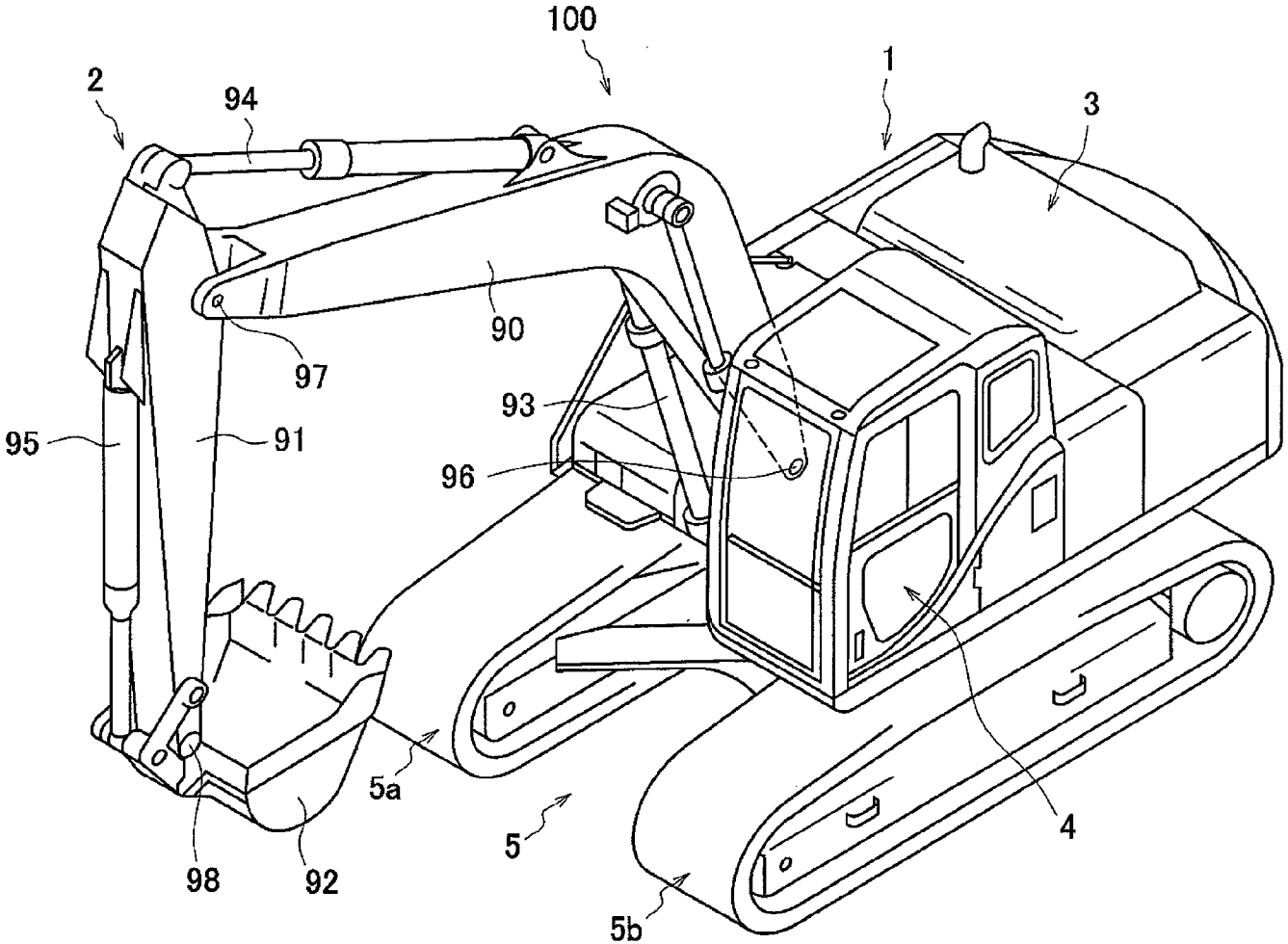
FIG. 1 is an external view of a hydraulic excavator according to an embodiment of the present invention.

A hydraulic excavator according to an embodiment of the present invention shall be explained in detail with reference to the figures. FIG. 1 is a perspective view of a hydraulic excavator 100. The hydraulic excavator 100 is equipped with a vehicle body 1 and working implement 2. The vehicle body 1 has a revolving upper unit 3, an operating cabin 4, and an undercarriage 5. The revolving upper unit is provided on the undercarriage 5. The revolving upper unit 3 is provided in a rotatable manner with respect to the undercarriage 5. The revolving upper unit 3 contains equipment such as an engine and a hydraulic pump described below. The operating cabin 4 is provided in the front section of the revolving upper unit 3. A boom operating device and a rotation operating device described below are provided inside the operating cabin 4. The undercarriage 5 includes crawler belts 5*a* and 5*b*, and the hydraulic excavator 100 travels due to the rotation of the crawler belts 5*a* and 5*b*.

The working implement 2 is attached to the front section of the vehicle body 1 and includes a boom 90, an arm 91, a bucket 92, a boom cylinder 93, and arm cylinder 84, and a bucket cylinder 95. The proximal end part of the boom 90 is attached in a swingable manner to the revolving upper unit 3 via a boom pin 96. The proximal end part of the arm 91 is attached in a swingable manner to the distal end part of the boom 90 via an arm pin 97. The bucket 92 is attached in a swingable manner to the distal end part of the arm 91 via a bucket pin 98. The boom cylinder 93, the arm cylinder 94, and the bucket cylinder 95 are all hydraulic cylinders that are driven by hydraulic pressure. The boom cylinder 93 drives the boom 90. The arm cylinder 94 drives the arm 91. The bucket cylinder 95 drives the bucket 92.

Figure 2:
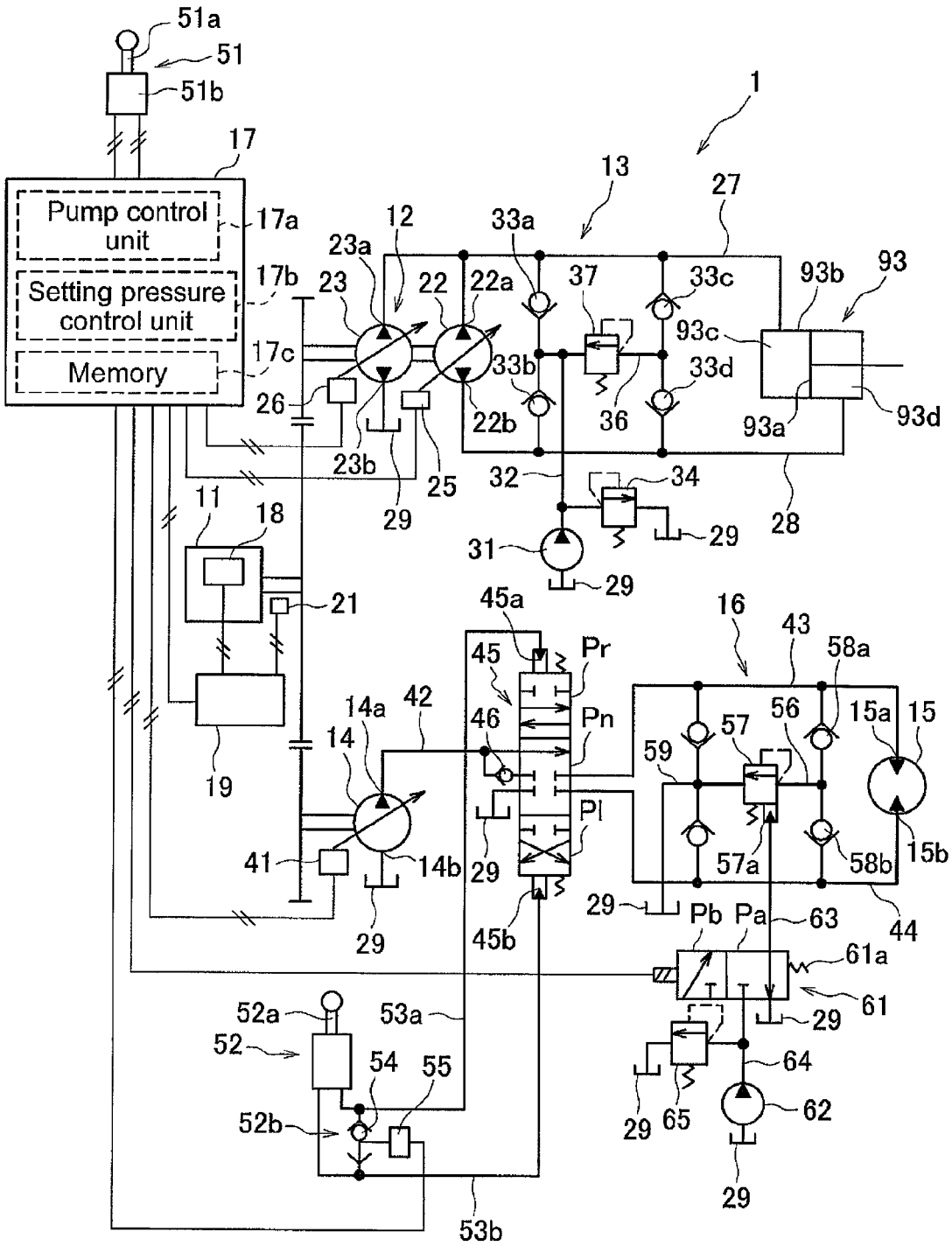
FIG. 2 is a block diagram illustrating a configuration of a hydraulic drive system provided in the hydraulic excavator.

FIG. 2 is a block diagram illustrating a configuration of a hydraulic drive system 1 provided in the hydraulic excavator 100. The hydraulic drive system 1 includes an engine 11, a first hydraulic pump 12, a first hydraulic circuit 13, the above-mentioned boom cylinder 93, a second hydraulic pump 14, a hydraulic motor 15, a second hydraulic circuit 16, and a pump controller 17.

The engine 11 drives the first hydraulic pump 12 and the second hydraulic pump 14. The engine 11 is an example of a driving source in the present invention. The engine 11 is, for example, a diesel engine, and the output of the engine 11 is controlled by adjusting an injection amount of fuel from a fuel injection device 18. The adjustment of the fuel injection amount is performed by the fuel injection device 18 that is controlled by an engine controller 19. An actual rotation speed of the engine 11 is detected by a rotation speed sensor 21, and a detection signal is input into the engine controller 19 and the pump controller 17.

The engine controller 19 controls the output of the engine 11 by controlling the fuel injection device 18. Engine output torque characteristics set on the basis of a set target engine rotation speed and a work mode are mapped and stored in the engine controller 19. The engine output torque characteristics indicate the relationship between the output torque and the rotation speed of the engine 11. The engine controller 19 controls the output of the engine 11 on the basis of the engine output torque characteristics.

The first hydraulic pump 12 discharges hydraulic fluid. The boom cylinder 93 drives the boom 90 via hydraulic fluid discharged from the first hydraulic pump 12. The first hydraulic pump 12 includes a first boom pump 22 and a second boom pump 23. The first boom pump 22 and the second boom pump 23 are driven by the engine 11 to discharge hydraulic fluid.

The first boom pump 22 is a variable displacement hydraulic pump. A discharge flow rate of the first boom pump 22 is controlled by controlling the tilt angle of the first boom pump 22. The tilt angle of the first boom pump 22 is controlled by a first pump flow rate control device 25. The first pump flow rate control device 25 controls the discharge flow rate of the first boom pump 22 by controlling the tilt angle of the first boom pump 22 on the basis of command signals from the pump controller 17.

The first hydraulic pump 22 is a two-directional discharge hydraulic pump. Specifically, the first boom pump 22 includes a first pump port 22*a* and a second pump port 22*b*. The first hydraulic pump 22 is switchable between a first discharge state and a second discharge state. In the first discharge state, hydraulic fluid is supplied to the second pump port 22*b*, and the first boom pump 22 discharges hydraulic fluid from the first pump port 22*a*. In the second discharge state, hydraulic fluid is supplied to the first pump port 22*a*, and the first boom pump 22 discharges hydraulic fluid from the second pump port 22*b*.

The second boom pump 23 is a variable displacement hydraulic pump. The discharge flow rate of the second hydraulic pump 23 is controlled by controlling a tilt angle of the second hydraulic pump 23. The tilt angle of the second hydraulic pump 23 is controlled by a second pump flow rate control unit 26. The second pump flow rate control unit 26 controls the discharge flow rate of the second boom pump 23 by controlling the tilt angle of the second boom pump 23 on the basis of command signals from the pump controller 17.

The second hydraulic pump 23 is a two-directional discharge hydraulic pump. Specifically, the second hydraulic pump 23 includes a first pump port 23*a* and a second pump port 23*b*. The second hydraulic pump 23 is switchable between the first discharge state and the second discharge state in the same way as the first hydraulic pump 22. In the first discharge state, hydraulic fluid is supplied to the second pump port 23*b*, and the second hydraulic pump 23 discharges hydraulic fluid from the first pump port 23*a*. In the second discharge state, hydraulic fluid is supplied to the first pump port 23*a*, and the second hydraulic pump 23 discharges hydraulic fluid from the second pump port 23*b*.

The boom cylinder 93 is driven by hydraulic fluid discharged from the first hydraulic pump 22 and the second boom pump 23. The boom cylinder 93 includes a cylinder rod 93*a* and a cylinder tube 93*b*. The cylinder rod 93*a* partitions the inside of the cylinder tube 93*b* into a first chamber 93*c* and a second chamber 93*d*. The boom cylinder 93 expands and contracts by switching between the supply and exhaust of hydraulic fluid to and from the first chamber 93*c* and the second chamber 93*d*. Specifically, the boom cylinder 93 extends due to the supply of hydraulic fluid into the first chamber 93*c* and the exhaust of hydraulic fluid from the second chamber 93*d*. The boom cylinder 93 contracts due to the supply of hydraulic fluid into the second chamber 93*d* and the exhaust of hydraulic fluid from the first chamber 93*c*.

A pressure receiving area of the cylinder rod 93*a* in the first chamber 93*c* is greater than a pressure receiving area of the cylinder rod 93*a* in the second chamber 93*d*. Therefore, when the boom cylinder 93 is extended, more hydraulic fluid is supplied to the first chamber 93*c* than is exhausted from the second chamber 93*d*. When the boom cylinder 93 is contracted, more hydraulic fluid is exhausted from the first chamber 93*c* than is supplied to the second chamber 93*d*.

The first hydraulic circuit 13 is connected to the first hydraulic pump 22, the second hydraulic pump 23, and the boom cylinder 93. The first hydraulic circuit 13 configures a closed circuit between the first hydraulic pump 12 and the boom cylinder 93. Specifically, the first hydraulic circuit 13 includes a first boom path 27 and a second boom path 28. The first boom path 27 connects the first chamber 93*c* of the boom cylinder 93 and the first pump port 22*a* of the first boom pump 22. The first boom path 27 is a path for supplying hydraulic fluid to the first chamber 93*c* of the boom cylinder 93, or for recovering hydraulic fluid from the first chamber 93*c* of the boom cylinder 93.

The first boom path 27 is connected to the first pump port 23*a* of the second hydraulic pump 23. Therefore, hydraulic fluid is supplied to the first boom path 27 from both the first boom pump 22 and the second boom pump 23. The second boom path 28 is connected to the second chamber 93*d* of the boom cylinder 93 and the second pump port 22*b* of the first boom pump 22. The second boom path 28 is a path for supplying hydraulic fluid to the second chamber 93*d* of the boom cylinder 93, or for recovering hydraulic fluid from the second chamber 93*d* of the boom cylinder 93. The second pump port 23*b* of the second hydraulic pump 23 is connected to a hydraulic fluid tank 29. Therefore, hydraulic fluid is supplied to the second boom path 28 from the first boom pump 22. The first hydraulic circuit 13 configures a closed circuit between the first hydraulic pump 12 and the boom cylinder 93 due to the first boom path 27 and the second boom path 28.

The hydraulic drive system 1 further includes a charge pump 31. The charge pump 31 is a hydraulic pump for replenishing hydraulic fluid to the first hydraulic circuit 13. The charge pump 31 is driven by the engine 11 to discharge hydraulic fluid. The charge pump 31 is a fixed displacement hydraulic pump. The first hydraulic circuit 13 further includes a charge path 32. The charge path 32 is connected to the first boom path 27 via a check valve 33*a*. The check valve 33*a* is open when the hydraulic pressure of the first boom path 27 is lower than the hydraulic pressure of the charge path 32. The charge path 32 is connected to the second boom path 28 via a check valve 33*b*. The check valve 33*b* is open when the hydraulic pressure of the second boom path 28 is lower than the hydraulic pressure of the charge path 32.

The charge path 32 is also connected to the hydraulic fluid tank 29 via a charge relief valve 34. The charge relief valve 34 maintains the hydraulic pressure in the charge path 32 at a predetermined charge pressure. When the hydraulic pressure of the first boom path 27 or the second boom path 28 falls below the hydraulic pressure of the charge path 32, hydraulic fluid from the charge pump 31 is supplied to the first boom path 27 or the second boom path 28 via the charge path 32. As a result, the hydraulic pressures of the first boom path 27 and the second boom path 28 are maintained at or above a predetermined value.

The first hydraulic circuit 13 further includes a relief path 36. The relief path 36 is connected to the first boom path 27 via a check valve 33*c*. The check valve 33*c* is open when the hydraulic pressure of the first boom path 27 is higher than the hydraulic pressure of the relief path 36. The relief path 36 is connected to the second boom path 28 via a check valve 33*d*. The check valve 33*d* is open when the hydraulic pressure of the second boom path 28 is higher than the hydraulic pressure of the relief path 36. The relief path 36 is connected to the charge path 32 via a relief valve 37. The relief valve 37 maintains the pressure of the relief path 36 at a pressure equal to or less than a predetermined relief pressure. As a result, the hydraulic pressures of the first boom path 27 and the second boom path 28 are maintained at or below a predetermined relief pressure.

When the boom cylinder 93 is expanded, the first hydraulic pump 22 and the second hydraulic pump 23 are driven in the first discharge state. As a result, hydraulic fluid discharged from the first pump port 22*a* of the first boom pump 22 and from the first pump port 23*a* of the second boom pump 23 passes through the first boom path 27 to be supplied to the first chamber 93*c* of the boom cylinder 93. Hydraulic fluid in the second chamber 93*d* of the boom cylinder 93 passes through the second boom path 28 to be recovered in the second pump port 22*b* of the first boom pump 22. As a result, the boom cylinder 93 expands.

When the boom cylinder 93 is contracted, the first hydraulic pump 22 and the second hydraulic pump 23 are driven in the second discharge state. As a result, hydraulic fluid discharged from the second pump port 22*b* of the first boom pump 22 passes through the second boom path 28 to be supplied to the second chamber 93*d* of the boom cylinder 93. Further, hydraulic fluid in the first chamber 93*c* of the boom cylinder 93 passes through the first boom path 27 to be recovered in the first pump port 22*a* of the first boom pump 22 and the first pump port 23*a* of the second boom pump 23. As a result, the boom cylinder 93 contracts.

The second hydraulic pump 14 is driven by the engine 11 to discharge hydraulic fluid. The hydraulic fluid discharged from the second hydraulic pump 14 is supplied to the hydraulic motor 15. The second hydraulic pump 14 is a variable displacement hydraulic pump. The discharge flow rate of the second hydraulic pump 14 is controlled by controlling the tilt angle of the second hydraulic pump 14. The tilt angle of the second hydraulic pump 14 is controlled by a third pump flow rate control device 41. The third pump flow rate control device 41 controls the discharge flow rate of the second hydraulic pump 14 by controlling the tilt angle of the second hydraulic pump 14 on the basis of command signals from the pump controller 17.

The second hydraulic pump 14 has a first pump port 14*a* and a second pump port 14*b*. The second pump port 14*b* of the second hydraulic pump 14 is connected to the hydraulic fluid tank 29. Hydraulic fluid is supplied to the second pump port 14*b* in the second hydraulic pump 14, and the second hydraulic pump 14 discharges hydraulic fluid from the first pump port 14*a*.

The hydraulic motor 15 is driven by hydraulic fluid discharged from the second hydraulic pump 14 to rotate the revolving upper unit 3. The hydraulic motor 15 includes a first motor port 15*a* and a second motor port 15*b*. The hydraulic motor 15 is driven in a direction for rotating the revolving upper unit 3 to the right (referred to as "right rotation direction" below) by hydraulic fluid being supplied to the first motor port 15*a* and hydraulic fluid being discharged from the second motor port 15*b*. The hydraulic motor 15 is driven in a direction for rotating the revolving upper unit 3 to the left (referred to as "left rotation direction" below) by hydraulic fluid being supplied to the second motor port 15*b* and hydraulic fluid being discharged from the first motor port 15*a*.

The second hydraulic circuit 16 is provided independently from the first hydraulic circuit 13 and connects the second hydraulic pump 14 and the hydraulic motor 15. Specifically, the second hydraulic circuit 16 includes a pump path 42, a first motor path 43, and a second motor path 44. The pump path 42 is connected to the first pump port 14*a* of the second hydraulic pump 14. The first motor path 43 is connected to the first motor port 15*a* of the hydraulic motor 15. The second motor path 44 is connected to the second motor port 15*b* of the hydraulic motor 15.

A hydraulic pressure control valve 45 is provided between the second hydraulic pump 14 and the hydraulic motor 15 in the second hydraulic circuit 16. The hydraulic pressure control valve 45 controls the flow rate of hydraulic fluid flowing toward the hydraulic motor 15. As a result, the driving hydraulic pressure of the hydraulic motor 15, namely the rotation torque of the revolving upper unit 3, is controlled. The hydraulic pressure control valve 45 is switchable between a right rotation position state Pr, a left rotation position state Pl, and a neutral position state Pn. The hydraulic pressure control valve 45 connects the pump path 42 and the first motor path 43 in the right rotation position state Pr.

The pump path 42 and the first motor path 43 are connected via a check valve 46. The check valve 46 allows the flow of hydraulic fluid from the pump path 42 toward the first motor path 43 and prohibits the flow of hydraulic fluid from the first motor path 43 toward the pump path 42. Thus, hydraulic fluid discharged from the second hydraulic pump 14 passes through the pump path 42, the hydraulic pressure control valve 45, and the first motor path 43 to be supplied to the first motor port 15*a* of the hydraulic motor 15. As a result, the hydraulic motor 15 is driven in the right rotation direction. The hydraulic pressure control valve 45 connects the pump path 42 and the second motor path 44 in the left rotation position state Pl.

The pump path 42 and the second motor path 44 are connected via the check valve 46. The check valve 46 allows the flow of hydraulic fluid from the pump path 42 toward the second motor path 44 and prohibits the flow of hydraulic fluid from the second motor path 44 toward the pump path 42. Thus, hydraulic fluid discharged from the second hydraulic pump 14 passes through the pump path 42, the hydraulic pressure control valve 45, and the second motor path 44 to be supplied to the second motor port 15*b* of the hydraulic motor 15. As a result, the hydraulic motor 15 is driven in the left rotation direction. The hydraulic pressure control valve 45 shuts off communication between the pump path 42 and the first motor path 43 in the neutral position state Pn. The hydraulic pressure control valve 45 shuts off communication between the pump path 42 and the second motor path 44 in the neutral position state Pn. As a result, the supply of hydraulic fluid from the second hydraulic pump 14 toward the hydraulic motor 15 is stopped and the driving of the hydraulic motor 15 is stopped.

Although omitted in FIG. 2, the abovementioned arm cylinder 94 and the bucket cylinder 95 are connected to the second hydraulic pump 14 via the second hydraulic circuit 16. The arm cylinder 94, the bucket cylinder 95, and the hydraulic motor 15 are connected in parallel to the second hydraulic pump 14. Therefore, hydraulic fluid discharged from the second hydraulic pump 14 is diverted to the arm cylinder 94, the bucket cylinder 95, and the hydraulic motor 15 for driving the arm cylinder 94, the bucket cylinder 95, and the hydraulic motor 15 respectively.

The hydraulic excavator 100 further includes a boom operating device 51 and a rotation operating device 52. The boom operating device 51 includes a boom operating member 51*a* and a boom operation detecting unit 51*b*. The boom operating member 51*a* is a member for operating the boom 90. Specifically, the boom operating member 51*a* is operated by the operator for operating the boom cylinder 93. The boom operating member 51*a* is operable in two directions: a direction for expanding the boom cylinder 93 from the neutral position, and a direction for contracting the boom cylinder 93.

The boom operation detecting unit 51*b* detects the operation amount and the operating direction of the boom operating member 51*a*. The boom operation detecting unit 51*b* is, for example, a sensor for detecting a position of the boom operating member 51*a*. When the boom operating member 51*a* is positioned in the neutral position, the operation amount of the boom operating member 51*a* is zero. Detection signals for indicating the operation amount and the operating direction of the boom operating member 51*a* are input into the pump controller 17 from the boom operation detecting unit 51*b*.

The rotation operating device 52 includes a rotation operating member 52*a* and a rotation operation detecting unit 52*b*. The rotation operating member 52*a* is a member for operating the rotation of the revolving upper unit 3. Specifically, the rotation operating member 52*a* is operated by the operator for operating the hydraulic motor 15. The rotation operating member 52*a* is operable in two directions: a direction for driving the hydraulic motor 15 in the right rotation direction from the neutral position, and a direction for driving the hydraulic motor 15 in the left rotation direction. The rotation operation detecting unit 52*b* detects an operation amount of the rotation operating member 52*a*.

Specifically, the rotation operating device 52 is connected to a first pilot port 45*a* of the hydraulic pressure control valve 45 via a first pilot path 53*a*. The rotation operating device 52 is connected to a second pilot port 45*b* of the hydraulic pressure control valve 45 via a second pilot path 53*b*. When the rotation operating member 52*a* is operated in the right rotation direction, hydraulic fluid is supplied to the first pilot port 45*a* of the hydraulic pressure control valve 45 via the first pilot path 53*a*. As a result, the hydraulic pressure control valve 45 is switched to the abovementioned right rotation position state Pr. When the rotation operating member 52*a* is operated in the left rotation direction, hydraulic fluid is supplied to the second pilot port 45*b* of the hydraulic pressure control valve 45 via the second pilot path 53*b*. As a result, the hydraulic pressure control valve 45 is switched to the abovementioned left rotation position state P1.

The hydraulic pressure control valve 45 controls the supply flow rate to the hydraulic motor 15 in response to pilot pressure applied to the first pilot port 45*a* or the second pilot port 45*b* The rotation operation detecting unit 52*b* includes a shuttle valve 54 and a hydraulic pressure sensor 55. The shuttle valve 54 connects the hydraulic pressure sensor to a path with the highest pilot pressure among the first pilot path 53*a* and the second pilot path 53*b*. As a result, the hydraulic pressure sensor 55 detects the highest pilot pressure among the pilot pressures of the first pilot path 53*a* and the second pilot path 53*b*. A detection signal indicating the pilot pressure detected by the hydraulic pressure sensor 55 is input into the pump controller 17 from the rotation operation detecting unit 52*b*. The pilot pressure corresponds to the operation amount of the rotation operating member 52*a*. Therefore, the pump controller 17 is able to learn the operation amount of the rotation operating member 52*a* on the basis of the detection signals from the hydraulic pressure sensor 55.

The second hydraulic circuit 16 further includes a relief path 56 and a relief valve 57. The relief path 56 is connected to the first motor path 43 via a check valve 58*a*. The relief path 56 is connected to the second motor path 44 via a check valve 58*b*. Therefore, the relief path 56 and the relief valve 57 are located further downstream than the hydraulic pressure control valve 45 in the flow of hydraulic fluid from the second hydraulic pump 14 toward the hydraulic motor 15 in the second hydraulic circuit 16.

The check valve 58*a* is open when the hydraulic pressure of the first motor path 43 is higher than the hydraulic pressure of the relief path 56. The check valve 58*b* is open when the hydraulic pressure of the second motor path 44 is higher than the hydraulic pressure of the relief path 56. The relief path 56 is connected to a tank path 59 via the relief valve 57. The tank path 59 is connected to the hydraulic fluid tank 29. The relief valve 57 connects the relief path 56 and the tank path 59 when the hydraulic pressure of the relief path 56 becomes higher than a predetermined setting pressure. Thus, the relief valve 57 maintains the hydraulic pressure of the relief path 56 at or below the predetermined setting pressure. As a result, the hydraulic pressures of the first motor path 43 and the second motor path 44 are maintained at or below the setting pressure. Specifically, the relief valve 57 adjusts the hydraulic pressure of the second hydraulic circuit 16 so that the driving hydraulic pressure of the hydraulic motor 15 does not exceed the setting pressure. The relief valve 57 is an example of the hydraulic pressure adjusting mechanism in the present invention.

The relief valve 57 is a so-called two-stage relief valve that allows the setting pressure to be switched between a predetermined first setting pressure and a predetermined second setting pressure. The second setting pressure is lower than the first setting pressure. The setting pressure of the relief valve 57 is set to the first setting pressure during normal operations and is switched to the second setting pressure when the belowmentioned predetermined condition is satisfied. The first setting pressure is 30 MPa, for example, and corresponds to the driving hydraulic pressure of the hydraulic motor 15 during normal operations. In contrast, the second setting pressure is a value that approximates the driving hydraulic pressure of the boom cylinder 93 for raising the boom 90 during the combined rotation operation, and is, for example, 13 MPa to 17 MPa. The second setting pressure is an average value of the driving hydraulic pressure of the boom cylinder 93 when raising the boom 90 during the combined rotation operation, and is derived by testing or simulation conducted beforehand.

The setting pressure of the relief valve 57 is switched by a setting pressure switching unit 61. The setting pressure switching unit 61 switches the setting pressure to the second setting pressure by supplying hydraulic fluid discharged from a pilot pump 62 to a relief pilot port 57*a* of the relief valve 57. The setting pressure switching unit 61 maintains the setting pressure at the first setting pressure when hydraulic fluid discharged from the pilot pump 62 is not supplied to the relief pilot port 57*a* of the relief valve 57. The setting pressure switching unit 61 is, for example, an electromagnetic control valve and is switched between a first position state Pa and a second position state Pb in response to a command signal from the pump controller 17.

Specifically, the setting pressure switching unit 61 is maintained at the first position state Pa due to a biasing force from a biasing member 61*a* when no command signal is received from the pump controller 17. The setting pressure switching unit 61 is maintained in the second position state Pb in a state in which a command signal is input from the pump controller 17.

The setting pressure switching unit 61 shuts off communication between a pilot pump path 64 and a relief pilot path 63 in the first position state Pa. The pilot pump path 64 is connected to the pilot pump 62. The relief pilot path 63 is connected to the relief pilot port 57*a* in the relief valve 57. The relief pilot path 63 is connected to the hydraulic fluid tank 29 when the setting pressure switching unit 61 is in the first position state Pa. Hydraulic fluid discharged from the pilot pump 62 is not supplied to the relief pilot port 57*a* of the relief valve 57 when the setting pressure switching unit 61 is in the first position state Pa. As a result, the setting pressure of the relief valve 57 is maintained at the first setting pressure.

The setting pressure switching unit 61 connects the pilot pump path 64 and the relief pilot path 63 in the second position state Pb. Therefore, hydraulic fluid discharged from the pilot pump 62 is supplied to the relief pilot port 57*a* of the relief valve 57 when the setting pressure switching unit 61 is in the second position state Pb. As a result, the setting pressure of the relief valve 57 is switched to the second setting pressure. The pilot pump path 64 is connected to the hydraulic fluid tank 29 via a pilot relief valve 65. The pilot relief valve 65 maintains the hydraulic pressure of the pilot pump path 64 at or below a predetermined relief pressure.

The pump controller 17 controls the first hydraulic pump 12 in response to an operation amount of the boom operating member 51*a*. The pump controller 17 controls the second hydraulic pump 14 in response to an operation amount of the rotation operating member 52*a*. The pump controller 17 controls the setting pressure of the relief valve 57 in response to the operation amount of the boom operating member 51*a*. The pump controller 17 includes a pump control unit 17*a*, *a* setting pressure control unit 17*b*, and a memory 17*c*. The pump control unit 17*a* and setting pressure control unit 17*b* may be realized by a calculation device such as a CPU or the like. The memory 17*c* may be realized by a recording device such as a RAM, a ROM, a hard disk, a flash memory, or the like. The memory 17*c* stores information for controlling the first hydraulic pump 12 and the second hydraulic pump 14.

The pump control unit 17*a* calculates a target flow rate of the hydraulic fluid supplied to the boom cylinder 93 in response to the operation amount of the boom operating member 51*a*. The pump control unit 17*a* further calculates a target flow rate of the hydraulic fluid supplied to the hydraulic motor 15 in response to the operation amount of the rotation operating member 52*a*.

The setting pressure control unit 17*b* reduces the driving hydraulic pressure of the hydraulic motor 15 by reducing the setting pressure of the relief valve 57 when a predetermined condition is satisfied. The setting pressure control unit 17*b* and the relief valve 57 are examples of the motor hydraulic pressure reduction unit of the present invention. The predetermined condition is that an operation of the boom operating member 51*a* for raising the boom 90 and an operation of the rotation operating member 52*a* for rotating the revolving upper unit 3 are conducted together and the operation amount of the boom operating member 51*a* (referred to as "boom raising operation amount" below) is equal to or greater than a predetermined threshold Y0 (see FIG. 3). Specifically, the predetermined condition is that the boom raising operation amount during the combined rotation operation is equal to or greater than the predetermined threshold Y0. For example, if the maximum operation amount is assumed to be 100%, the predetermined threshold Y0 is set as a value that is less than 100%. Specifically, the predetermined threshold Y0 is a value that is 70% to 80%.

Figure 3:
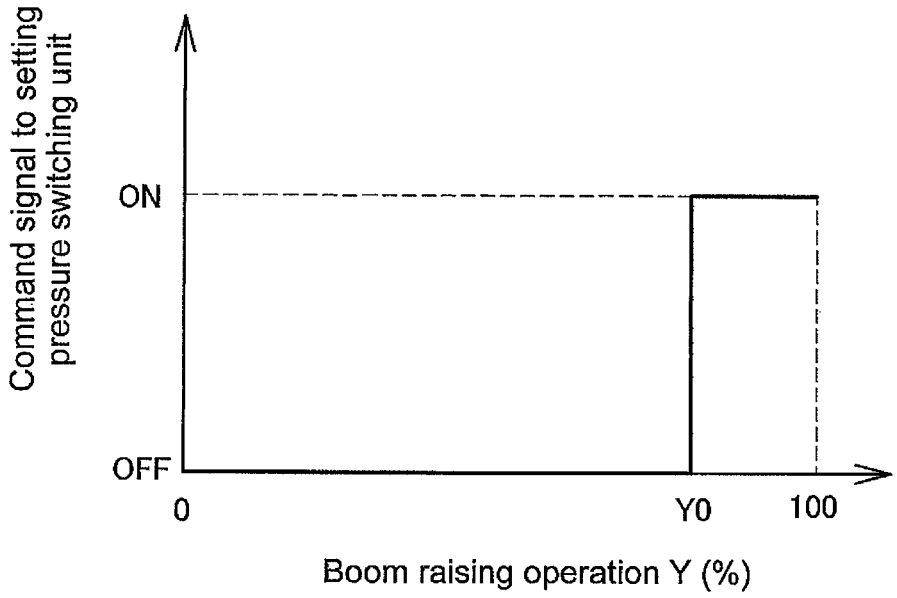
FIG. 3 illustrates a relationship between a boom raising operation amount and a command signal to a setting pressure switching unit during a combined rotation operation.

The setting pressure control unit 17*b* maintains the setting pressure switching unit 61 at the first position state Pa during normal operations when the predetermined condition is not satisfied. FIG. 3 illustrates a relationship between the boom raising operation amount and a command signal to the setting pressure switching unit 61 during the combined rotation operation. As illustrated in FIG. 3, the command signal to the setting pressure switching unit 61 is OFF while the boom raising operation amount is less than the predetermined threshold Y0 (see FIG. 3) even during the combined rotation operation. As a result, the setting pressure of the relief valve 57 is maintained at the first setting pressure.

The setting pressure control unit 17*b* turns the command signal to the setting pressure switching unit 61 ON when the boom raising operation amount during the combined rotation operation is equal to or greater than the predetermined threshold Y0. As a result, the setting pressure switching unit 61 is switched to the second position state Pb and the setting pressure of the relief valve 57 is switched from the first setting pressure to the second setting pressure. Therefore, the driving pressure of the hydraulic motor 15 is reduced to a pressure equal to or less than the second setting pressure. As a result, the acceleration of the rotation of the revolving upper unit 3 is reduced. However, the rotation of the revolving upper unit 3 is maintained at a steady-state velocity since the flow rate of hydraulic fluid supplied to the hydraulic motor 15 is maintained.

The hydraulic excavator 100 according to the present embodiment has the following features.

The driving hydraulic pressure of the hydraulic motor 15 is reduced to a value near the driving hydraulic pressure of the boom cylinder 93 when the boom raising operation amount is equal to or greater than the predetermined threshold Y0 during the combined rotation operation. Thus, the acceleration of the rotation of the revolving upper unit 3 can be reduced and the rotating time of the revolving upper unit 3 and the raising amount of the boom 90 during the rotating time can be synchronized. Further, since the predetermined condition is not satisfied, for example, during an independent operation of the rotation, the driving hydraulic pressure of the hydraulic motor 15 is not reduced by the relief valve 57. As a result, the acceleration of the rotation and the rotational force can be maintained.

Further, since the predetermined condition is not satisfied even when the boom raising operation amount is less than the predetermined threshold Y0 during the combined rotation operation, the driving hydraulic pressure of the hydraulic motor 15 is not reduced by the relief valve 57. As a result, the acceleration of the rotation and the rotational force can be maintained when raising the boom 90 a small amount even when the combined rotation operation is being conducted. For example, the combined rotation operation is conducted when performing side-hitting excavation. Side-hitting excavation is work that involves, for example, performing excavation while hitting the side face of the trench with the bucket for straightening the trench. Therefore, a strong rotational force is preferred for hitting the side face of the trench with the bucket when performing side-hitting excavation. The boom raising operation amount during side-hitting excavation is less than the abovementioned predetermined threshold Y0 since there is no need to raise the boom 90 much during the side-hitting excavation. As a result, the driving hydraulic pressure of the hydraulic motor 15 is not reduced by the relief valve 57 during side-hitting excavation in the hydraulic excavator 100 according to the present embodiment. Thus, the rotational force can be maintained during side-hitting excavation.

Since the driving hydraulic pressure of the hydraulic motor 15 is reduced when the predetermined condition is satisfied, the acceleration of the rotation of the revolving upper unit 3 is reduced but the steady-state velocity of the rotation of the revolving upper unit 3 is maintained. Consequently, a reduction in the steady-state velocity of the rotation can be prevented.

The relief valve 57 is located downstream from the hydraulic pressure control valve 45 in the second hydraulic circuit 16. As a result, the driving hydraulic pressure of the hydraulic motor 15 can be changed by the relief valve 57 independently of the hydraulic pressure control valve 45. Therefore, the driving hydraulic pressure of the hydraulic motor 15 can be reduced by the relief valve 57 regardless of the control of the driving hydraulic pressure of the hydraulic motor 15 by the hydraulic pressure control valve 45.

Although an embodiment of the present invention has been described so far, the present invention is not limited to the above embodiments and various modifications may be made within the scope of the invention.

Figure 4:
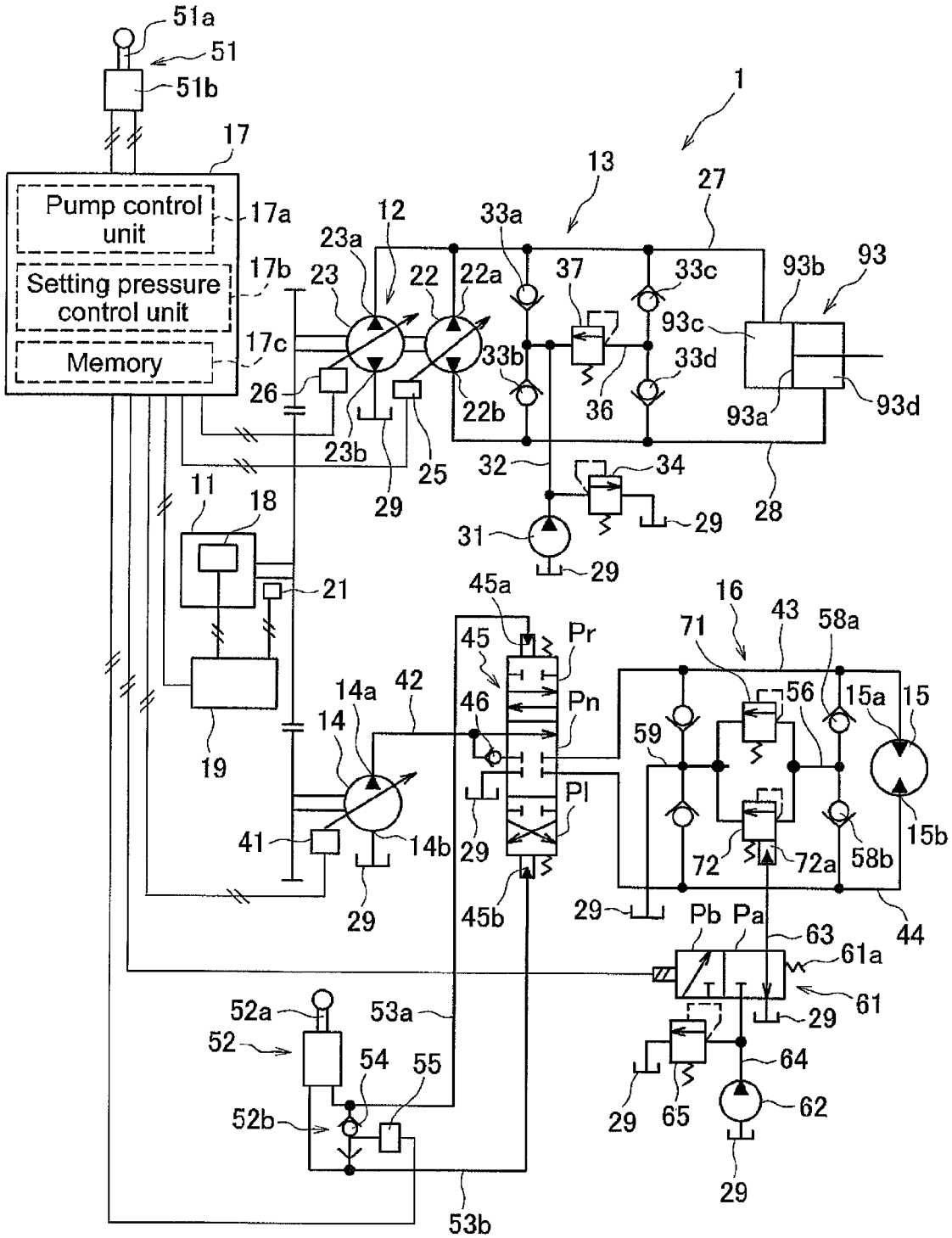
FIG. 4 is a block diagram illustrating a configuration of a hydraulic drive system provided in the hydraulic excavator according to another embodiment.

The hydraulic pressure adjusting mechanism of the present invention may have other configurations without being limited to the relief valve 57 of the above embodiment. For example, as illustrated in FIG. 4, a first relief valve 71 and a second relief valve 72 may be used as the hydraulic pressure adjusting mechanism. The first relief valve 71 adjusts the hydraulic pressure of the second hydraulic circuit 16 so that the driving hydraulic pressure of the hydraulic motor 15 does not exceed the predetermined first setting pressure. The second relief valve 72 adjusts the hydraulic pressure of the second hydraulic circuit 16 so that the driving hydraulic pressure of the hydraulic motor 15 does not exceed the second setting pressure which is lower than the first setting pressure when pilot pressure is applied to a relief pilot port 72*a*. The second relief valve 72 adjusts the hydraulic pressure of the second hydraulic circuit 16 so that the driving hydraulic pressure of the hydraulic motor 15 does not exceed a third setting pressure which is greater than the first setting pressure when pilot pressure is not applied to the relief pilot port 72*a*.

The setting pressure control unit 17*b* maintains the setting pressure switching unit 61 at the first position state Pa when the predetermined condition is not satisfied. As a result, the hydraulic pressure in the second hydraulic circuit 16 is adjusted by the first relief valve 71 and the driving hydraulic pressure of the hydraulic motor 15 is maintained at a value equal to or less than the first setting pressure. The setting pressure control unit 17*b* sends a command signal to the setting pressure switching unit 61 so that the setting pressure switching unit 61 switches to the second position state Pb when the predetermined condition is satisfied. As a result, the setting pressure of the second relief valve 72 is switched from the third setting pressure to the second setting pressure. As a result, the hydraulic pressure in the second hydraulic circuit 16 is adjusted by the second relief valve 72 and the driving hydraulic pressure of the hydraulic motor 15 is reduced to a hydraulic pressure equal to or less than the second setting pressure. The second relief valve 72 may be set to not open when pilot pressure is not applied to the relief pilot port 72*a* of the second relief valve 72.

Figure 5:
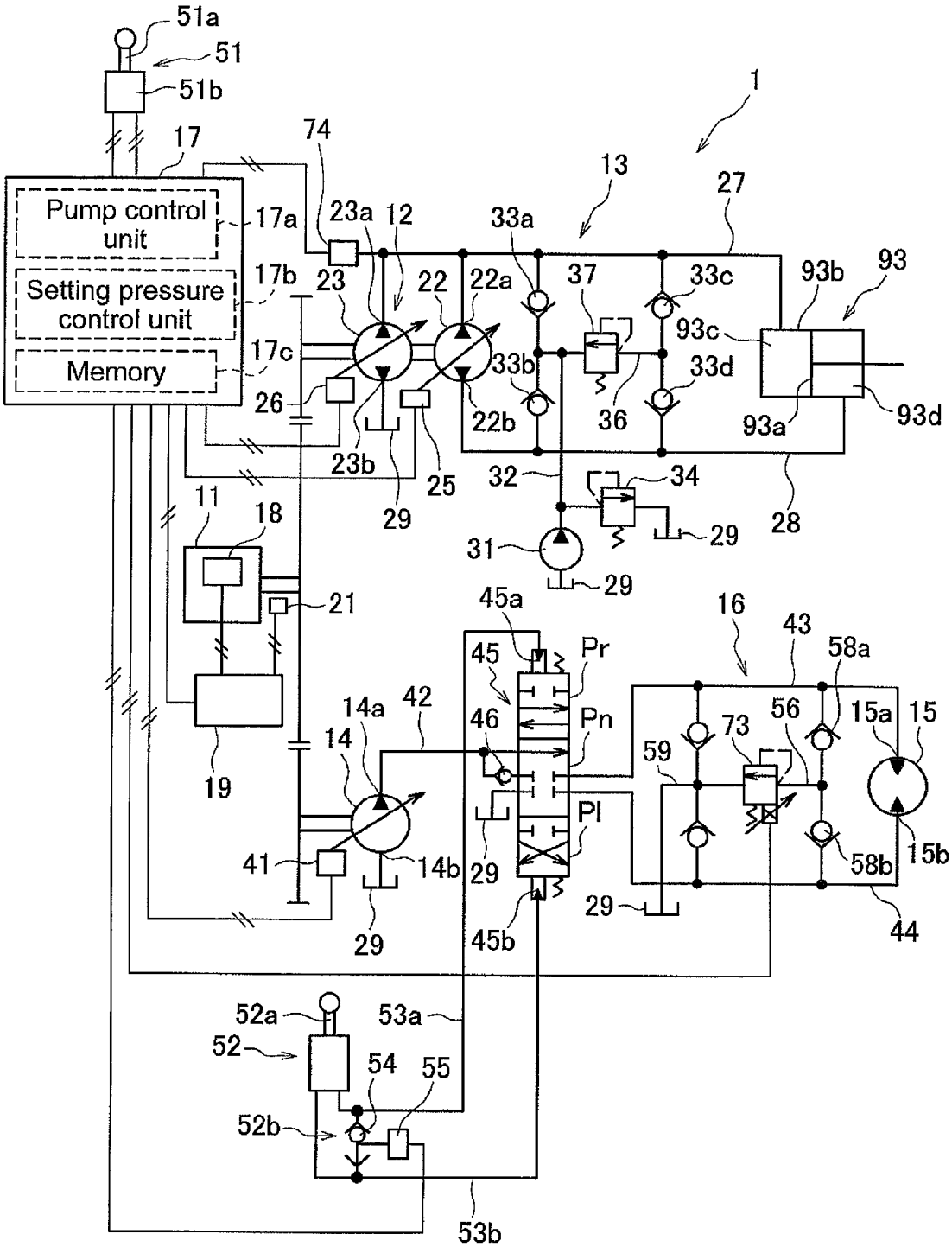
FIG. 5 is a block diagram illustrating a configuration of a hydraulic drive system provided in the hydraulic excavator according to another embodiment.

As illustrated in FIG. 5, a variable relief valve 73 may be used as the hydraulic pressure adjusting mechanism. The variable relief valve 73 allows for a continuous change of the setting pressure. The variable relief valve 73 changes the setting pressure on the basis of a command signal from the pump controller 17. In this case, the hydraulic drive system 1 further includes a cylinder hydraulic pressure detecting unit 74. The cylinder hydraulic pressure detecting unit 74 detects the driving hydraulic pressure of the boom cylinder 93. The setting pressure control unit 17*b* changes the setting pressure of the variable relief valve 73 in response to the driving hydraulic pressure of the boom cylinder 93 detected by the cylinder hydraulic pressure detecting unit 74.

Figure 6:
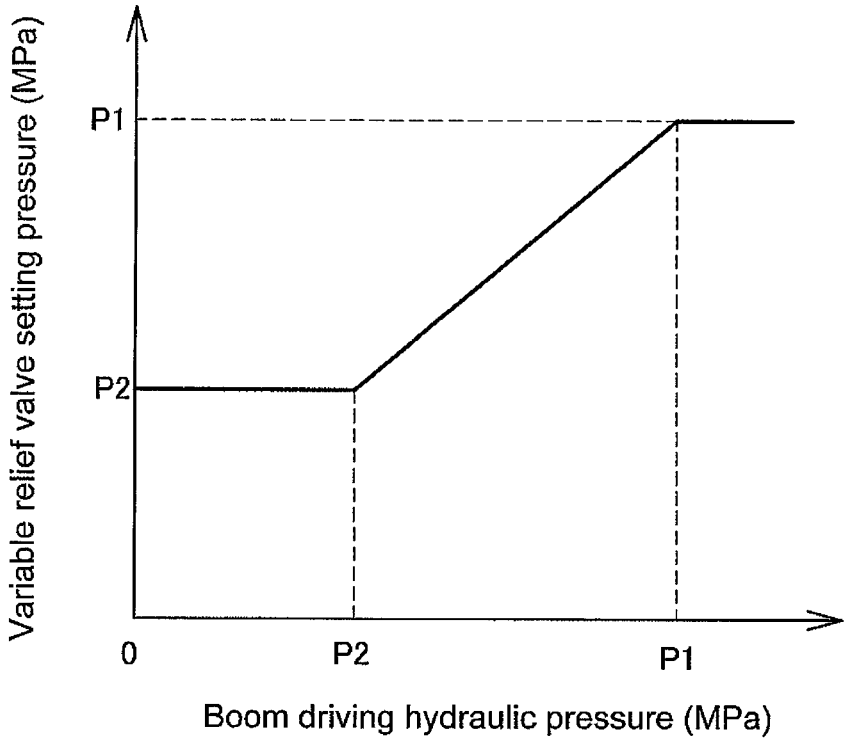
FIG. 6 illustrates a relationship between a boom driving hydraulic pressure and a setting pressure of a variable relief valve in the hydraulic excavator according to another embodiment.

Specifically, the setting pressure control unit 17*b* changes the setting pressure of the variable relief valve 73 as illustrated in FIG. 6. The horizontal axis in FIG. 6 represents the driving hydraulic pressure of the boom 90 detected by the cylinder hydraulic pressure detecting unit 74. The vertical axis is the setting pressure of the variable relief valve 73. As illustrated in FIG. 6, the setting pressure of the variable relief valve 73 can be changed within a range between a first setting pressure P1 and a second setting pressure P2. The setting pressure of the variable relief valve 73 is set to a value that is the same as that of the driving hydraulic pressure of the boom 90 when the driving hydraulic pressure of the boom 90 is a value between the first setting pressure P1 and the second setting pressure P2. As a result, the driving hydraulic pressure of the hydraulic motor 15 can be reduced to a value corresponding to the driving hydraulic pressure of the boom cylinder 93. Thus, the rotating time of the revolving upper unit 3 and the raising amount of the boom 90 during the rotating time can be synchronized with a higher level of accuracy. The setting pressure of the variable relief valve 73 is maintained at the first setting pressure P1 when the driving hydraulic pressure of the boom 90 is greater than the first setting pressure P1. The setting pressure of the variable relief valve 73 is maintained at the second setting pressure P2 when the driving hydraulic pressure of the boom 90 is less than the second setting pressure P2.

While the present invention is applicable to a twin pump hydraulic drive system in which two hydraulic pumps 22 and 23 are connected to the boom cylinder 93 in the above embodiments, the present invention may also be applicable to a single pump hydraulic drive system in which one hydraulic pump is connected to the boom cylinder 93.

According to the present invention, synchronization of the rotation time of the revolving upper unit and the boom raising amount during the rotation time is made possible in a hydraulic excavator that uses a hydraulic circuit in which the boom circuit is independent.

What is claimed is:

1. A hydraulic excavator comprising:

an undercarriage;

a revolving upper unit disposed on the undercarriage, the revolving upper unit being configured to rotate with respect to the undercarriage;

a working implement including a boom pivotably attached to the revolving upper unit;

a first hydraulic pump configured to discharge hydraulic fluid;

a hydraulic cylinder configured to drive the boom with hydraulic fluid discharged from the first hydraulic pump;

a first hydraulic circuit connecting the first hydraulic pump and the hydraulic cylinder, the first hydraulic circuit forming a closed circuit between the first hydraulic pump and the hydraulic cylinder;

a second hydraulic pump configured to discharge hydraulic fluid;

a hydraulic motor configured to rotate the revolving upper unit with hydraulic fluid discharged from the second hydraulic pump;

a second hydraulic circuit provided independently of the first hydraulic circuit, the second hydraulic circuit connecting the second hydraulic pump and the hydraulic motor;

a boom operating member configured to operate the boom;

a rotation operating member configured to operate a rotation of the revolving upper unit; and a motor hydraulic pressure reduction unit configured to reduce a driving hydraulic pressure of the hydraulic motor when a predetermined condition is satisfied, the predetermined condition being a condition in which an operation of the boom operating member to raise the boom and an operation of the rotation operating member to rotate the revolving upper unit are conducted together and an operation amount of the boom operating member is equal to or greater than a predetermined threshold.

2. The hydraulic excavator according to claim 1, wherein the motor hydraulic pressure reduction unit is configured to reduce the driving hydraulic pressure of the hydraulic motor so that an acceleration of the rotation of the revolving upper unit is reduced when the predetermined condition is satisfied.

3. The hydraulic excavator according to claim 1, wherein the motor hydraulic pressure reduction unit is configured to reduce the driving hydraulic pressure of the hydraulic motor so that a steady-state velocity of the rotation of the revolving upper unit is maintained and an acceleration of the rotation of the revolving upper unit is reduced when the predetermined condition is satisfied.

4. The hydraulic excavator according to claim 1, wherein the motor hydraulic pressure reduction unit includes a hydraulic pressure adjusting mechanism provided in the second hydraulic circuit and a setting pressure control unit configured to control the hydraulic pressure adjusting mechanism;

the hydraulic pressure adjusting mechanism is configured to adjust a hydraulic pressure of the second hydraulic circuit so that the driving hydraulic pressure of the hydraulic motor does not exceed a predetermined setting pressure;

the setting pressure is variable; and the setting pressure control unit is configured to reduce the setting pressure when the predetermined condition is satisfied.

5. The hydraulic excavator according to claim 4, wherein the hydraulic pressure adjusting mechanism is a relief valve that allows switching of the setting pressure between a predetermined first setting pressure and a predetermined second setting pressure lower than the first setting pressure; and the setting pressure control unit is configured to switch the setting pressure from the first setting pressure to the second setting pressure when the predetermined condition is satisfied.

6. The hydraulic excavator according to claim 4, wherein the hydraulic pressure adjusting mechanism includes a first relief valve and a second relief valve;

the first relief valve is configured to adjust a hydraulic pressure of the second hydraulic circuit so that the driving hydraulic pressure of the hydraulic motor does not exceed the predetermined first setting pressure;

the second relief valve is configured to adjust a hydraulic pressure of the second hydraulic circuit so that the driving hydraulic pressure of the hydraulic motor does not exceed the second setting pressure lower than the first setting pressure; and the setting pressure control unit is configured to control the first relief valve to adjust the hydraulic pressure of the second hydraulic circuit when the predetermined condition is not satisfied, and the second relief valve to adjust the hydraulic pressure of the second hydraulic circuit when the predetermined condition is satisfied.

7. The hydraulic excavator according to claim 5, wherein the second setting pressure is equal to the driving hydraulic pressure of the hydraulic cylinder when raising the boom.

8. The hydraulic excavator according to claim 4, further comprising a cylinder hydraulic pressure detecting unit configured to detect a driving hydraulic pressure of the hydraulic cylinder, the hydraulic pressure adjusting mechanism being a relief valve that allows a continuous change of the setting pressure, and the setting pressure control unit being configured to change the setting pressure in response to the driving hydraulic pressure of the hydraulic cylinder detected by the cylinder hydraulic pressure detecting unit.

9. The hydraulic excavator according to claim 4, further comprising:

a hydraulic pressure control valve provided in the second hydraulic circuit, the hydraulic pressure control valve being configured to control the driving hydraulic pressure of the hydraulic motor, the hydraulic pressure adjusting mechanism being located further downstream than the hydraulic pressure control valve in a flow path of hydraulic fluid from the second hydraulic pump toward the hydraulic motor in the second hydraulic circuit.

* * * * *